US005381780A

United States Patent [19]

Yelton et al.

[11] Patent Number: 5,381,780

[45] Date of Patent: Jan. 17, 1995

[54] GREEN AND CURED CONCRETE

[75] Inventors: Darrell A. Yelton, Lee'3 s Summit; Kevin R. Wilson, Blue Springs, both of Mo.

[73] Assignee: Diamant Boart, Inc., Kansas City, Mo.

[21] Appl. No.: 76,209

[22] Filed: Jun. 14, 1993

Related U.S. Application Data

[63] Continuation of Ser. No. 869,167, Apr. 16, 1992, Pat. No. 5,241,946.

[51] Int. Cl.[6] ..... E21C 47/00

[52] U.S. Cl. ..... 125/14; 125/13.01; 299/39

[58] Field of Search ..... 125/12, 13.01, 13.03, 125/14; 51/170 PT, 176, 177; 299/39

[56] References Cited

U.S. PATENT DOCUMENTS

| | | | |
|---|---|---|---|
| 2,673,725 | 3/1954 | Coates | 51/176 |
| 3,301,601 | 1/1967 | Zuzelo | 51/176 |
| 3,357,745 | 12/1967 | Cooper | 51/176 |
| 4,840,431 | 6/1989 | Jedick | 125/14 |
| 4,889,675 | 12/1989 | Chiuminatta et al. | 264/154 |
| 4,953,523 | 9/1990 | Swan | 125/14 |
| 5,048,141 | 9/1991 | Hüppi | 51/177 |

*Primary Examiner*—Robert A. Rose

*Attorney, Agent, or Firm*—Kokjer, Kircher, Bowman & Johnson

[57] ABSTRACT

A saw for grooving concrete includes a base supported by plurality of wheels such that a cutting guide of the base may press against the green concrete with a predetermined load. A cutter frame is pivotally mounted to the base and includes a cutting blade and drive means mounted thereto. The pivotal connection between the frame and the base is spaced from the cutting blade such that pivoting the frame with respect to the base will raise and lower the cutting blade between operative and inoperative positions. A handle is connected to the saw and extends rearwardly and upwardly therefrom such that an operator may stand behind the saw to push it during operation. The handle is pivotally mounted to the saw such that pushing the handle downwardly will cause the frame to pivot upwardly with respect to the base. The handle is telescopic and includes a pivot connection such that it may be folded to a storage or travel position. A depth stop is connected between the frame and the base to limit the travel of the frame towards the base, and thus provide a depth adjustment for the cutting blade.

5 Claims, 2 Drawing Sheets

GREEN AND CURED CONCRETE

This is a continuation of application Ser. No. 07/869,167, filed Apr. 16, 1992, now U. S. Pat. No. 5,241,946.

BACKGROUND OF THE INVENTION

1. Field of the Invention

The present invention relates in general to concrete saws. In particular, the present invention relates to an improved saw for the grooving of uncured or green, in addition to cured concrete to aid in crack control.

2. Description of the Related Art

It has been known for many years to provide grooves in concrete for crack control. The formation of the groove in the concrete provides an area of reduced strength to ensure that the cracks which form during shrinkage of the concrete will be formed along the line of the groove rather than at some other point. This has important structural implications, in addition to providing a more aesthetically pleasing appearance.

The traditional method of forming grooves was to manually form the groove by use of a trowel. This is a time consuming process which requires a fair amount of skill. Additionally, since this must be performed when the concrete is recently poured, the concrete will not support the weight of the laborer forming the grooves. This makes it especially difficult to form grooves across large slabs of concrete is to cut the grooves with a rotating saw blade. *The Guide for Concrete Floor and Slab Construction*, American Concrete Institute, No. ACI 302.1R-80 (hereinafter "ACI Guide") shows that such grooves should be cut when it has hardened sufficiently to support a worker with at most a ¼ inch foot indention in the concrete surface, but before the concrete has dried sufficiently to cause random cracking, and that this requires the concrete to be cut within 4 to 12 hours after finishing. The ACI Guide also teaches that the grooves should be cut as soon as possible, with raveling of the edges and dislodging aggregate being the limiting factors as to how soon cutting may take place.

Various patents, such as U.S. Pat. Nos. 2,854,043 to Raymond and 3,623,518 to Nicotra teach the use of skid plates which contact the work surface closely adjacent counter rotating blades to reduce ravelling of the cut edges. U.S. Pat. Nos. 2,673,725 to Coates and 2,700,256 to Lewis disclose pivotal and biased mounting of concrete cutting blades to permit the blade to pass over obstructions in the concrete.

A light weight saw having such a skid plate and pivotally biased blade.

An alternative method of forming grooves in concrete has been proposed in U.S. Pat. No. 4,769,201 to Chiuminatta, et al. This patent teaches the cutting of a groove in partially cured concrete which may not be walked upon (i.e. the worker would sink greater that ¼ inch depth allowed in the ACI Guide), and therefore much less than 4 hours after finishing. This method of forming grooves has advantages over the manual trowel method, but has suffered from several drawbacks. The commercial form of the device shown in this patent must employ a special "ramp" to start the saw in the grooving operation. Additionally, the saw rests upon a skid plate which makes it difficult for the user to move the saw forward, and which may damage the surface of the uncured concrete. Also, the saw blade is raised out of the formed groove by rotation of a handle used to push the saw. This rotation is about the longitudinal axis of the handle and tends to rotate the saw and thus the cutting blade about an axis perpendicular to the cutting rotation of the saw blade, moving the saw off the desired line and widening the groove. Finally, the long handles removably mounted to the saw are often misplaced or not supplied with the saw, rendering it inoperative until a handle is supplied.

SUMMARY OF THE INVENTION

An object of the present invention is to provide a concrete saw which may be easily broken down and placed in a storage or travel position having small dimensions with no loose parts.

Another object of the present invention is to provide a concrete saw which allows adjustment of the cutting depth.

A further object of the present invention is to provide a concrete saw which may be used in confined areas and which will produce a cut which closely approaches an abutting or adjacent wall.

Yet another object of the present invention is to provide a concrete saw which may be both lowered into and raised out of cutting position quickly and easily, along the desired grooving line These and other objects are achieved by a saw for cutting concrete which includes a base supported by a plurality of wheels such that a cutting guide of the base will press against the concrete with a predetermined load. A cutter frame is pivotally mounted to the base and includes a cutting blade and drive means mounted thereto. The pivotal connection between the frame and the base is spaced from the cutting blade such that pivoting the frame with respect to the base will raise and lower the cutting blade between operative and inoperative positions. A handle is connected to the saw and extends rearwardly and upwardly therefrom so that an operator may stand behind the saw to push it during operation. The handle is pivotally mounted to the saw such that pushing the handle downwardly will cause the frame to pivot upwardly with respect to the base. The handle is telescopic and includes a pivot connection to allow folding to a storage or travel position. A depth stop is connected between the frame and the base to limit the travel of the frame towards the base, and thus provide a depth adjustment for the cutting blade.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
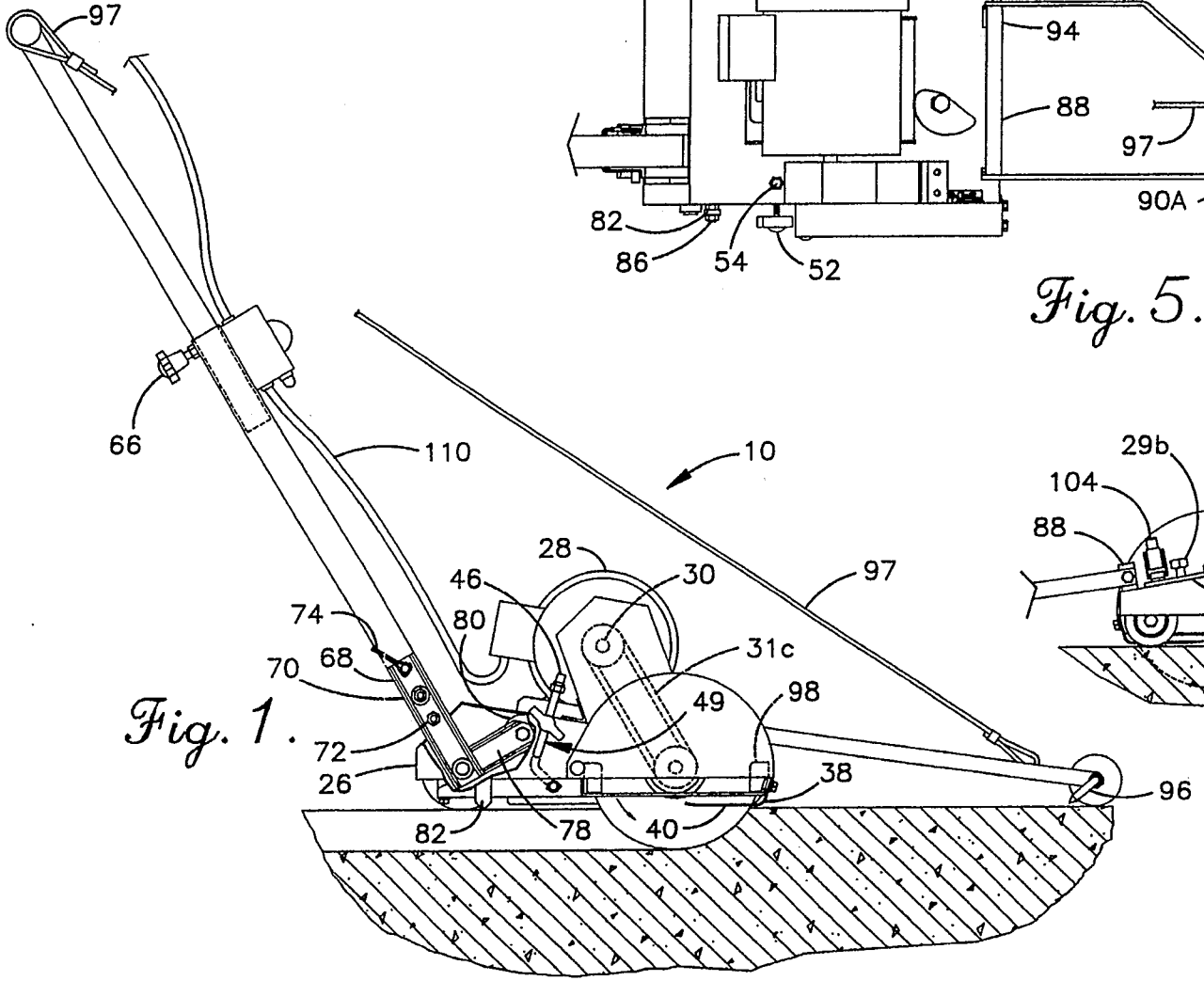
FIG. 1 is a side view and partial cutaway of the saw of the present invention in the operative position.
Figure 3:
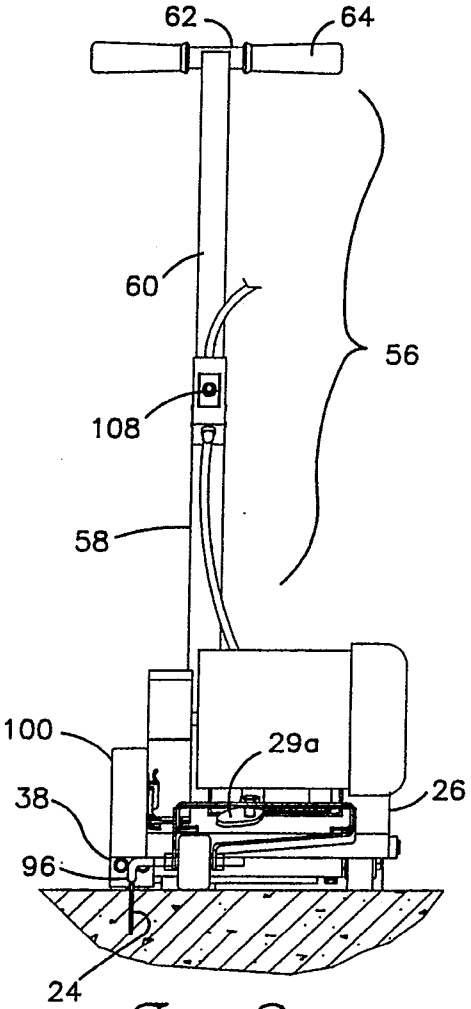
FIG. 3 is a front view of the saw of FIG. 1.
Figure 6:
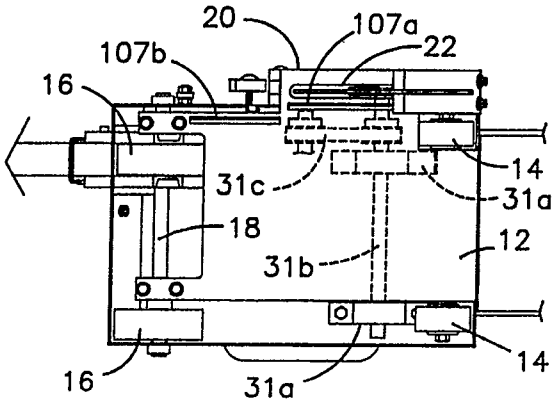
FIG. 6 is a bottom view of the saw of FIG. 1.
Figure 2:
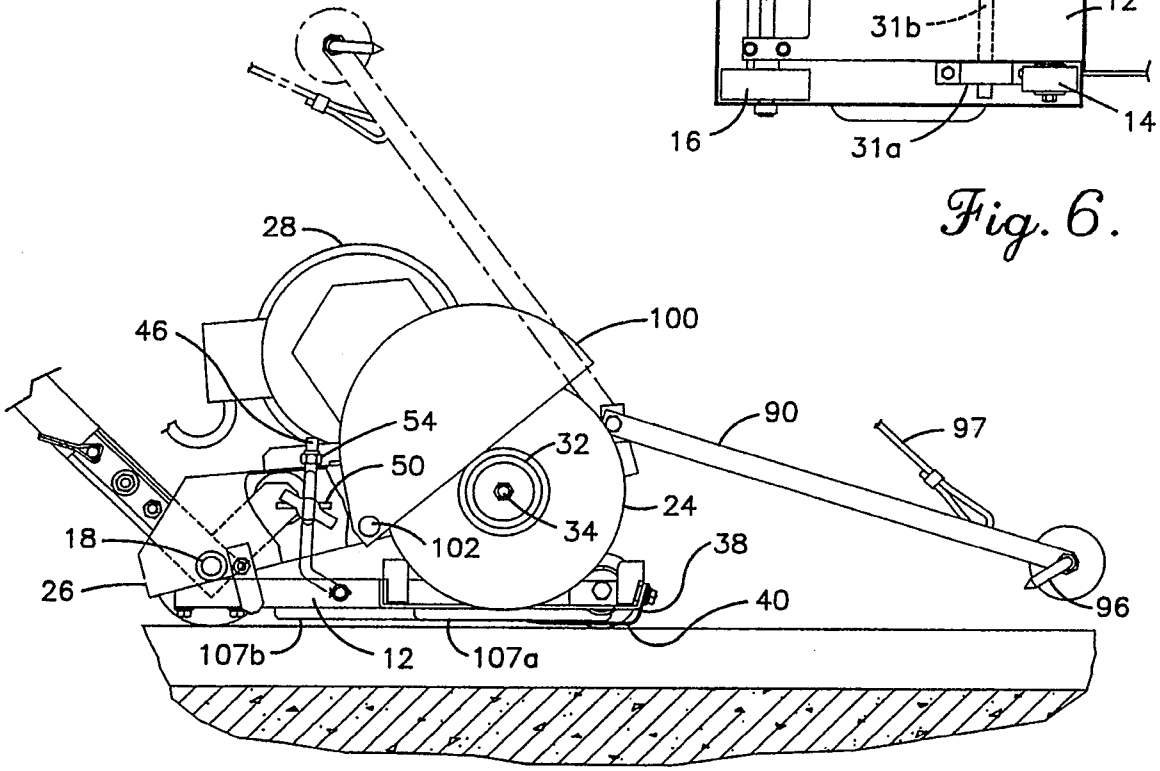
FIG. 2 is a detail side view and partial cutaway of the saw of the present invention in the raised inoperative position.

With reference to FIGS. 1 and 2, the saw according to the present invention is generally designated by reference numeral 10. As is best shown in FIGS. 2 and 6, the saw 10 includes a base 12 which is supported for movement with respect to the green concrete by a pair of front wheels 14 and a pair of rear wheels 16. The front wheels 14 may be supported for movement with respect to the base 12 by individual axes mounted on the base 12. However, for a reason made clear below, it is preferred that the rear wheels 16 are supported for rotation with respect to the base 12 by a single axle means 18. The axle means 18 may be connected to the base 12 by flanges formed in, or attached to, the base 12, with the flanges having appropriate through-holes to receive the axle means 18.

Since the saw is to be capable of travel upon uncured concrete, it is important that the wheels provide sufficient surface area for the saw's weight to ensure that the wheels do not mar the concrete surface. For this reason the wheels may be wider than that shown, or additional wheels may be provided.

The forward right hand side of the base 12 (with respect to the direction of travel) includes a blade extension 20 which is formed as a laterally extending continuation of the generally planar base 12. Formed within the blade extension 20 is an elongated blade slot 22 which is adapted to receive therein a blade 24 of the saw, which blade is described in more detail below. The blade extension 20 extends laterally outward from the main portion of the base 12. This lateral extension is to allow the cutting blade 24 to also be spaced laterally of the saw 10. This lateral spacing of the cutting blade 24 allows the user to more easily view the cutting blade, and thus the location of the cut when the saw is in use. Additionally, this lateral extension of the blade ensures that the other elements of the saw 10 extend laterally beyond the blade 24 by a minimum distance (i.e. the blade is close to the lateral edge of the saw). This allows the saw 10 to be used to form grooves which are spaced the minimum distance from adjacent walls or other obstacles.

A frame 26 is supported by the base 12. The frame 26 is in the general form of a cowling which encloses a downwardly opening interior cavity. The exterior periphery of the frame 26 corresponds substantially to that of base 12, or may have a slightly greater lateral extent such that it will partially cover the wheels 16 and 14, as shown in FIG. 6.

The frame 26 is pivotally mounted to the base 12 via the axle means 18. Specifically, as best shown in FIG. 6, the axle means 18 extends laterally beyond the outer edge of the rear wheels 16 and extends through appropriate apertures in the frame 26. As such, the frame 26 may pivot about the axle means 18, and bearings may be provided between the axle means and the frame to assist in this pivoting.

Preferably, the base 12 and frame 26 are formed such that portions of the outer periphery of both will substantially correspond, to provide a minimum of space between these elements. This will help to reduce the amount of dust which will enter into the space between the based 12 and frame 26.

Mounted upon the frame 26 is an electric motor 28. The motor 28 is fixed to a mounting plate 29 having bolts (not shown) extending upwardly through a mounting bracket of the motor. The mounting plate 29 is, in turn, mounted to the frame 26 by bolts (not shown) extending through holes in the mounting plate and then through slots, elongated in the direction of travel, formed through the frame 26. The use of the slots allows the motor to be moved forwardly and rearwardly with respect to the frame.

To assist in this movement, an adjustment cam **29*a* is mounted to the frame. The adjustment cam includes a cam surface which abuts against a forward edge of the mounting plate 29, such that rotation of the cam 29*a* in one direction will serve to push the motor rearwardly. A mounting bolt extends through the frame 26 and is threaded into the cam 29*a* to provide a stable rotation axis. A bolt head 29*b*, coaxial to this rotation axis, extends upwardly from the cam 29*a*. The user may thus engage the bolt head 29*b*** with a tool to effect the desired rotation.

Extending outwardly from the motor 28 is a main shaft 30, which includes at its free end a pulley. The underside of frame 26 mounts a pair of bushings **31*a*, which rotatably mount a drive shaft 31*b*. The drive shaft is substantially parallel to the main shaft, and includes a pulley at a position to allow an endless belt 31*c* to extend about the pulleys on the main and the drive shafts. As such, rotation of the main shaft of the motor will cause rotation of the drive shaft. The tension of the drive belt may be adjusted by movement of the motor with respect to the frame using the cam 29*a***, as described above, and an appropriate cowling may be provided to shield the belt and pulleys.

It should be apparent to those skilled in the art other drive arrangement could be employed, such as an internal combustion engine, a chain drive, or others.

The pulley of the drive shaft is spaced inwardly of the free end of the drive shaft, and this free end is threaded to receive an appropriate shaft bushing (not shown) to mount the blade 24. The blade 24 may be retained in place upon the shaft by use of a pair of blade flanges 32, one on either side of the blade, and a flange nut 34 which is tightened upon the drive shaft to compress the blade between the shaft bushing and the flange nut, thus fixing the blade in place. The blade 24 may be of any type suitable for the grooving of concrete, but is preferably an abrasion blade formed of compressed metal particles and may have a plurality of notches extending inwardly from the outer periphery, as is known in the art.

As should be readily understood, the motor 28 will thus drive the blade 24 via the drive shaft.

The placement of the motor upon the frame 26 is such that the operation the center of gravity of the motor is roughly centered between the wheels 16 and 14 as may be envisioned from FIG. 6. Since the motor 28 will typically be one of, if not the, heaviest element of the saw 10, this placement of the center of gravity insures that the saw 10 will be stable in operation.

The weight of the motor 28 also performs another important function in the present invention. Specifically, as the frame 26 which mounts the motor 28 is freely pivoted to the base at the rearward edge, it is the weight of the motor and frame combination which will maintain the blade 24 in the lowered condition during operation. Since the concrete which will be cut by the blade 24 includes aggregate material throughout, the cutting blade 24 may have a tendency to ride upwardly over the aggregate rather than passing through, and thus cutting, the aggregate. It is important that the aggregate be cut during the formation of the groove, as a piece of aggregate extending across a groove will transmit forces and thus allow a crack to propagate outside the weakened groove, thus defeating the object of groove formation.

It is therefore preferred that the motor and frame combination have sufficient weight to maintain the blade 24 in the lowered condition to part the aggregate during operation. The increased hardness of the aggregate relative to the surrounding concrete may require the operator to move the saw forward at a much slower pace than normal as a groove is formed through the aggregate, but this is greatly preferred to allowing the aggregate to remain in place.

The motor 28 drives the blade 24 in a counter-rotating direction, as indicated by the arrow in FIG. 1. The drive shaft is mounted at such a position on the frame 26 such that when the frame is lowered with respect to the base the blade 24 will extend below the level of the ground upon which the wheels rest, such that the blade 24 may cut a groove within the concrete surface. As is known in the cutting art, the counter-rotation of the blade 24 to cut the groove within the concrete surface may cause chipping of the concrete surface adjacent the forward portion of the blade. This is due to the upward pressure exerted on the concrete by the blade at this forward portion.

To reduce or eliminate this chipping of the concrete, it is preferred that the saw 10 include a cutting guide 38. The cutting guide 38 may comprise a rigid member which will support the concrete along the entire length of the cutting blade 24 as shown in the above noted U.S. Pat. No. 4,769,201. However, it is preferred that the cutting guide 38 be formed as that shown in U.S. Pat. No. 3,623,518 to Nicotra.

The Nicotra patent solves the chipping problem associated with a counter-rotating blade by use of an abbreviated cutting guide which supports the surface to be cut only adjacent the forward portion of the saw blade. As such, the cutting guide 38 of the present invention is mounted to the base 12 and extends downwardly and rearwardly to be disposed below the blade slot 22. (Although shown spaced upwardly from the concrete surface for clarity in the drawings, in actuality the cutting guide 38 will rest upon the upper concrete surface.) The cutting guide 38 is preferably formed of a material, such as plastic or light gauge sheet metal, which will allow it to flex, and thus conform to, any surface irregularities in the concrete.

To provide flex within the cutting guide 38, it is possible that a rearwardly extending portion 40 of cutting guide 38 be angled downwardly when in the unloaded condition, rather than extending horizontally. With such an arrangement an upward force on the portion 40 will tend to cause bending of the cutting guide upward and to the rear. In the operative position this portion 40 will be thusly bent to be substantially horizontal.

The rearward end 42 of the cutting guide 38 is bent slightly upwardly to ensure that the cutting guide 38 does not catch upon an obstacle in the concrete surface when the saw 10 is moved rearwardly. As taught in Nicotra, the rear end of the cutting guide may be located forward of the axis of rotation of the blade. As is best shown in FIG. 6, the cutting guide 38 includes a guide slot 44 through which the blade 24 extends during operation, the guide slot being formed as is taught in Nicotra, noted above, which is included herein by reference.

In view of the previous discussion of placement of the center of gravity of motor 28 and the flexible nature of the cutting guide 38, it should be clear that the saw 10 is not supported by the cutting guide 38. While the wheels 14 and 16 provide the necessary support for the saw 10, it is possible and preferred that the cutting guide 38 be formed such that stabilizing pressure is applied to the surface of the concrete, for reasons taught in Nicotra, noted above. This is achieved by forming the cutting guide of the spring metal and providing it with a proper configuration such that it acts as a leaf spring pressed against the concrete when the portion 40 is bent upwardly and rearwardly by the surface of the concrete. This elastic deformation of the cutting guide results in the desired pressure applied by the guide when in use, as noted above.

As it is simply the physical characteristics of the cutting guide which determine the amount of pressure which the guide places upon the concrete surface, it is preferred that the cutting guide be fixed to the base 12 in such a manner that it is removable and replaceable. This may be achieved by attaching the cutting guide by one or more bolts, as shown in the drawings. By attaching the cutting guide in this manner, it is easy to replace the cutting guide with a different cutting guide having a different pressure exertion characteristic and/or different guide slot configurations to accommodate a different width blade 24.

Another important feature of the present invention is the ability to adjust the cutting depth of the saw 10. Depth adjustment is important for providing the proper depth groove for a particular concrete slab, and to accommodate for blade wear. This is accomplished by providing the saw 10 with means for limiting the pivotal movement of the frame 26 with respect to the base 12.

While various means could be employed, the preferred embodiment consists of a depth control rod 46 which has a generally L-shaped configuration with the lower horizontal leg extending outwardly through an aperture in an upstanding side wall of the base 12. A cotter pin may extend through the lower leg of the depth control rod to pivotally retain the rod within the aperture in the base wall. The upstanding portion of depth control rod 46 will extend upwardly through a the frame 26 extending outwardly therefrom at a position substantially above the hole in the base receiving the depth control rod.

The frame 26 includes a slot 49 at a position, and extending in a direction, corresponding to the rod 46. Slidingly mounted upon the depth control rod 46 is an adjustment collar 50. Adjustment collar 50 includes a threaded hole extending from the outer periphery thereof to the interior hole which receives the depth control rod. A depth adjustment knob 52 is passed through the slot 49 and threaded into this hole in the adjustment collar, such that continued tightening of the adjustment knob 52 will cause the adjustment collar 50 to be releasably fixed upon the depth control rod 46. The slot 49 extends near to the upper face of the frame 26, and the collar 50 has a sufficient height, the lower face of the frame 26 will rest upon the collar 50.

In this manner, the frame 26 may be pivoted upwardly with respect to the base 12, the adjustment collar 50 moved to the appropriate spot on the control rod 46 (possibly with the aid of markings on the rod) and thereafter fixed in place. Releasing the frame 26 will then allow the frame to pivot downwardly until the lower surface of the frame abuts against the upper surface of the collar 50, thus limiting downward pivoting of the frame with respect to the base. In this manner the projection of the blade 24 below the bottom of the wheels 14 and 16 may be adjusted, thus adjusting the depth of the groove cut by the saw 10.

It is noted that the formation of the slot 49 as a slot rather than a hole will allow upward pivoting of the frame and blade with respect to the base. As such the collar may be adjusted to the proper position for a specific depth of cut, the frame tilted upwardly such that the blade does not contact the concrete, the saw placed in the desired position and the motor activated to rotate the blade. The frame may the be lowered to cause the blade to produce a plunge cut into the concrete, which will stop at the proper preset depth, as the beginning of a groove to be cut. After the groove is finished the frame may be tilted upwardly to remove the blade from the groove.

The upper free end of the depth control rod 46 may be threaded to receive a retaining nut 54 having a diameter greater than that of the hole in the frame through which the rod 46 extends. This retaining nut will thus limit the upward pivoting of the frame with respect to the base, to allow the base to be pivoted up onto the rear wheels for transport between grooving operations. Alternatively, the collar may be lowered to an appropriate position such that the lower end of slot 49 will abut against the depth adjustment knob 52 during upward pivoting of the frame, prior to the abutment between the retaining nut 54 and frame 26.

It is also noted that during operation the weight of the motor and frame are transmitted only through the bearings connecting the frame to the axle means 18, and by the depth control rod 46. As such, the wheels 14 and 16 do not bear equal weights, but the rear wheels bear a greater weight. This eases the operator force to move the saw forward, and reduces the possibility of the weight of the front wheels marring the concrete surface, where the saw is used with green concrete.

To allow the user to easily control the placement and movement of the blade 24, the saw 10 includes a handle assembly generally indicated by reference numeral 56. The handle assembly 56 includes a handle support 58, a handle extension 60, a cross bar 62 mounted upon the handle extension 60 and a pair of grips 64 fixed upon the cross bar 62. The handle extension 60 preferably extends upwardly from the handle support 58 and includes means for telescoping the handle support with respect to the handle extension.

In the present embodiment, the handle support 58 is formed as a hollow member with the handle extension 60 being slidably received within the handle support 58. A handle extension knob is threaded through the wall of the handle support 58 such that tightening of the knob 66 will fix the relative positions of the support 58 and extension 60. This telescopic movement of the handle assembly will of course allow the handle to be adjusted to a height suited to the individual user, but the main purpose is to allow the length of the handle to be reduced for ease of transport.

Mounted to each lateral side of the lower end of the handle support 58 is an L-shaped handle bracket 68. As is best shown in FIG. 1, the upstanding portion of the L-shaped handle bracket is substantially parallel to the handle support 58 and is connected thereto by a bolt 72 which extends through both brackets 68 and the support 58, and is retained by an appropriate nut. At a position spaced from the bolt 72 a further hole extends through both brackets and the handle support, with this hole adapted to receive a quick release pin 74.

The spaced positioning of the bolt 72 and pin 74 ensures that the handle support 58 will be fixed with respect to the brackets 68. Removal of the quick release pin 74, however, will allow the handle support 58 to pivot with respect to the brackets 68 about the bolt 72. As such, the handle extension 60 may be slid within the handle support 58 and the handle support 58 then pivoted forwardly to rest above the frame 26. This will provide a compact storage or transport configuration.

It should be noted that the relative positions of the release pin 74 and bolt 72 may be reversed.

To assist in maintaining the handle brackets 68 in their proper configuration when the release pin 74 has been removed, the handle brackets 68 may be provided with a spacer means 76. This will essentially consist of a bolt extending through both handle brackets and supporting a cylindrical spacer (not shown) having a length substantially corresponding to the spaced position of the handle brackets. It should be apparent that to allow for the pivoting of the handle support with respect tot he handle brackets, that the spacer bolt 76 does not extend through the handle support 58, but rather the support 58 terminates at its lower end at a position above that of spacer bolt 76.

Fixed to the lower end of the upstanding portion 70 of each L-shaped handle bracket 68 is a leg portion 78 which extends outwardly from the upstanding portion at an angle thereto. The leg portion and upstanding portion may be formed as a single rigid member, or as a pair of members fixed together as by welding. Adjacent the intersection of the portions 70 and 78, each handle bracket 68 is provided with an appropriate pivot hole to receive the axle means 18 therethrough. As such, the handle assembly 56 is pivotally mounted to the axle means 18 to provide the connection with the base and frame.

This pivotal movement about the common axle means 18 is an important aspect of the present invention, as it allows the frame 26 to be raised and lowered by operator movement of the handle assembly 56 with a simple arrangement having minimal material and assembly costs. As may be seen by a comparison of the cutout portions in FIGS. 1 and 2, the free end of the leg portion 78 will abut against the underside of the frame 26 as the handle assembly 56 is rotated in a counter-clockwise direction. Further counter-clockwise rotation of the handle assembly 56 will cause the frame 26 to rotate with the handle assembly in a counter-clockwise direction, thus raising the saw blade with respect to the concrete surface.

This ability to raise and lower the saw blade is an important aspect of the present invention. By pivoting both the frame 26 and the handle assembly 56 about the axle means 18, the operator may raise and lower the saw blade from a standing position simply by movement of the handle assembly . Additionally, the motion of the handle required to move the saw blade is within the plane of the saw blade. As such, there is no tendency for the saw 10 or saw blade 24 to be moved out of this plane during raising or lowering of the saw blade. This allows the operator to place the saw blade for the beginning of a groove at exactly the proper location, and to lift the saw blade out of the existing groove without engaging the sides of the groove, possibly damaging the concrete surface.

To reduce vibration, noise and wear, the free end of the leg portion 78 may pivotally support a pivot roller 80. This pivot roller will engage with the frame 26 to smoothly transmit the pressure applied by the handle assembly 56. As there is no relative sliding movement between the free end of leg portion 78 and frame 26

(since they pivot about the same axis), the roller could be replaced by a simple rubber or plastic cap. It should be noted that where alternative types of motors are employed with the saw 10, the frame 26 may take shapes other than that shown in the drawings. In such situations, it is not necessary that the pivot roller 80 contact the underside of the frame 26, as contact between the leg portion of the handle bracket (or another portion of the handle bracket) and any bearing surface connected to the frame 26 is sufficient. Such a bearing surface could even be a portion, such as a bracket, connected to the upper side of the frame 26.

The handle assembly may provide further safety and convenience if it is of the proper weight. Specifically, it is preferred that the handle have sufficient weight that in its extended position it will hold up the frame and motor without operator intervention once these elements have been pivoted to the raised position. The gross weight of the saw is not greatly increased by this feature, since the moment arm of the handle increases, but the moment arm of the frame and motor decreases, as the frame is pivoted upwardly. This means that the handle need not weigh an equal amount to the frame and motor.

To assist in placing the groove in the proper location the saw 10 includes front and rear guide markers. The rear guide marker consists of a rear pointer 82 in the form of an elongated member. One end of the rear pointer 82 is pivotally connected to the frame 26 by means of a bolt 84 extending outwardly from the frame 26. The outwardly extending shaft of bolt 84 receives the rear pointer 82 with a nut 86 threaded on each side of the pointer 82. In this manner, the lateral position of the rear pointer 82 may be adjusted with respect to the frame 26 by appropriate rotation of the nuts 86. This will allow the rear pointer 82 to be placed at a position within the plane of the blade 24. It is also noted that the rear pointer 82 is mounted forwardly of the axle means 18. This will ensure that the rear pointer is lifted away from the concrete surface during raising of the frame.

Figure 5:
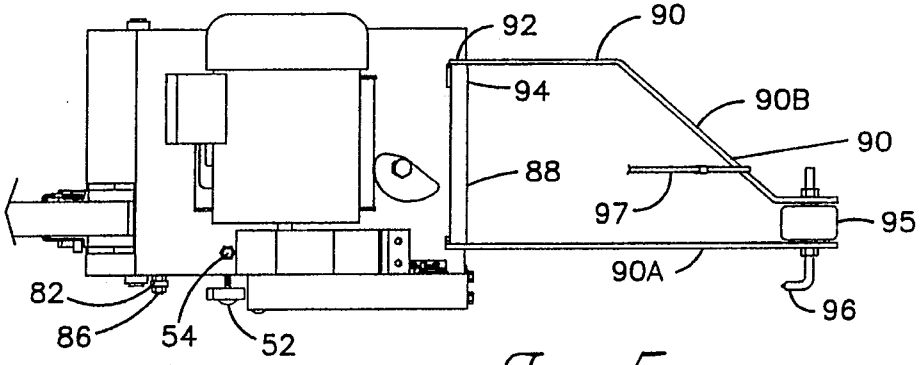
FIG. 5 is a top view of the saw of FIG. 1.
Figure 4:
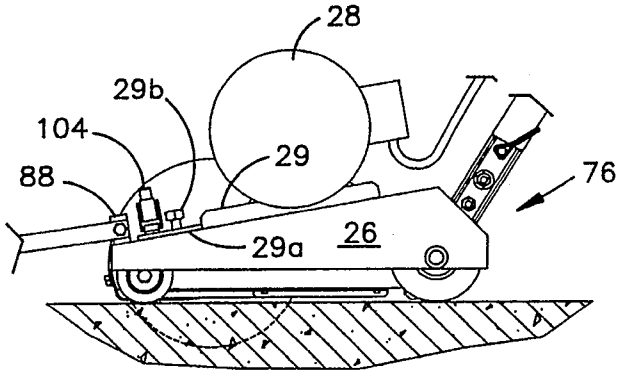
FIG. 4 is a left side view of the saw of FIG. 1.

With regard to the front guide means, a pair of pointer brackets 88 are fixed to the forward edge of the frame 26 for the mounting of a front pointer assembly 90. A bolt 92 extends through each pointer bracket 88 and the rear ends of the assembly 90. Nuts 94 secure the front pointer assembly 90 to the bolts 92 for pivoting thereabout. As may be seen best in FIG. 5, the portion of the assembly 90 adjacent the blade is substantially straight, while the portion furthest from the blade includes a dog leg 96, such that the free end of the front pointer assembly 90 adjacent the plane of the blade 24.

A pointer wheel 95 is rotatably mounted at the free end of the assembly 90, to provide support while preventing damage to the concrete surface, where the concrete is green. A pointer pin 96 is also mounted on this free end, and may advantageously be formed as an extension of the axle for the wheel 95. This pointer pin is within the plane of the blade, and may include adjustment means similar to that used for the rear pointer to allow movement of the pointer pin. In operation, the pointer assembly 90 will be pivoted forwardly such that the wheel 95 will roll upon the concrete surface as shown in FIG. 1. During storage and transport, and while approaching near blocking walls, the front pointer assembly 90 may be pivoted rearwardly to lay against the motor as shown dashed lines in FIG. 2. A flexible line 97 may run from a loop surrounding one of the grips 64 of the handle to a fixed position on the assembly 90. This will allow the operator to pull upon the line 97 to move the assembly 90 to the raised position, and thus approach a blocking wall, without releasing control of the saw 10.

During operation the blade 24 will create a large amount of dust due to the grooving operation. Allowing this dust to remain in place may adversely affect the concrete surface being grooved, and the airborne particles of dust may adversely affect the health of workers. As such, the saw 10 includes means for reducing and channeling the dust in the immediate vicinity of the saw blade 24.

As is best shown in FIG. 2, a deflector 98 is mounted at each end of the blade slot 22 on the blade extension 20 of the base 12. Each of the deflectors 98 has a substantially U-shaped cross section in a horizontal plane such that the shields 98 wrap around the forward and rearward ends of the saw blade when in use, as shown in FIG. 1. These shields 98 will channel the air flow, and thus the entrained dust particles, to reduce the amount of dust which is dispersed laterally of the saw 10.

Mounted upon the frame 26 is a blade guard 100. The blade guard 100 preferably covers a substantial portion of the exposed blade when it is in operation. This will provide for operator safety. Additionally, the blade guard 100 will extend over the deflectors 98 to define a substantially enclosed cavity covering the exposed portion of saw blade 24.

Due to the amount of the saw blade which the blade guard 100 covers, it is necessary for the guard 100 to be pivotally connected to the frame 26. As shown by comparison of FIGS. 1 and 2, the blade guard 100 may be connected to the frame 26 by a pivot bolt 102 at the rear of the blade guard. In this manner, the blade guard may be pivoted upwardly to access the flange nut 34 to allow the blade 24 to be removed from the drive shaft 30. To ensure that the blade guard 100 is maintained in its lowered position during operation, a quick release fastener, possibly in the form of a spring latch 104 may extend through a flange fastened to the blade guard 100 and be releasably connected to the frame 26.

While the formation of this cavity over the exposed portion of the saw blade will reduce the dispersal of the dust, it will not remove this dust. To this end the blade guard 100 may include a nozzle attachment (not shown) in the form of a tube opening into the cavity defined by the blade guard 100. In this manner a source of reduced pressure, such as a vacuum cleaner, may be connected to the nozzle attachment 106 to remove the dust as it is created during operation of the saw 10. When the source of reduced pressure is not employed with the saw 10, a cap (not shown) would be placed over the nozzle attachment 106.

An arrangement is also provided to limit the spread of the dust, such that it is primarily formed into a mound adjacent the groove. This arrangement is the provision of a forward and a rear dust plate **107*a* and 107*b*, best shown in FIGS. 2 and 6. Each dust plate is elongated in the direction of travel and has an L-shaped cross section. One of the legs of such L is fixed to the underside of the base, with the other leg extending downwardly. As shown in FIG. 6**, the downwardly extending legs are arranged adjacent the blade on the interior side thereof, and together extend from just in front of the forwardmost portion of the blade to a position well behind the blade. The dust plates will limit air currents laterally inward of the blade, causing the dust entrained therein to collect on the concrete surface adjacent the groove.

This will help to prevent damage to the remainder of the concrete surface, and reduces clean-up from the grooving operation.

To complete the saw 10, an appropriate switch 108 is provided where the motor 28 requires such. In the present embodiment, the switch 108 will be interposed along a electrical power cable 110 to provide the electrical power necessary to drive motor 28. The switch 108 (or the motor) may include an appropriate cut-off for stopping the motor 28 should it begin to overheat, along with appropriate reset switches to begin operation after the motor has cooled.

The operation of the device will now be described.

As noted above, the grooving operation will be performed prior to the full curing of the concrete. The concrete must, however, be sufficiently cured to support the weight of the saw and the operator without unduly damaging the surface thereof. As a general rule, it is preferred that the grooving operation take place just after the finishing of the concrete surface with power trowels or similar equipment. Markings will typically have been applied to the concrete, as by chalk strings, to show where the groove should be formed.

From its storage configuration, the handle support and handle extension 58 and 60 will be pivoted upwardly with respect to the handle brackets 68, and the quick release pin 74 inserted and fixed. The handle extension knob 66 will then be loosened and the handle extension 60 extended with respect to the handle support 58. The handle extension knob 66 will then be tightened to complete the handle assembly 56. Where the motor 28 is an electric motor, the electrical cable 110 will be connected to an appropriate outlet.

By tilting the handle assembly 56 rearwardly, the operator may lift the saw blade upwardly away from the concrete surface to maneuver the saw 10 into approximate starting position without engaging the blade with the surface of the concrete. At this point the front pointer 90 may be pivoted forwardly to its operative position shown in FIG. 1. Using the front and rear pointers, the operator will align these members with the chalk mark or other indication upon the concrete surface as to where the groove is to be formed.

The operator will then activate the motor 28 while the blade 24 is in the raised position. By slowly lowering the blade 24 by movement of the handle assembly 56, a plunge cut will be formed in the concrete surface. This plunge cut will continue until the lower surface of the frame 26 abuts against the depth adjustment collar 50, thus preventing further downward movement of the blade 24. At this point the operator may gradually move the saw forward, maintaining the pointers 90 and 82 aligned with the chalk line and groove, respectively.

During this forward motion, the front and rear wheels 14 and 16 provides the necessary support for the saw 10. This allows the saw 10 to roll easily rather than slide upon the cutting guide 38. While it is true that the cutting guide 38 will engage the surface of the concrete with a predetermined force, this is much less of an impediment to movement of the saw 10 than in previous concrete grooving devices. The possibility of the cutting guide damaging the surface of the concrete is also reduced with respect to previous devices.

Upon nearing an opposing wall, the front pointer 90 may be pivoted rearwardly to allow the saw 10 to approach closer to the opposing wall. The saw 10 is again moved forward until it is close to or abutting this opposing wall, with the forward placement of the saw blade 24 allowing groove formation very close to this opposing wall. The handle assembly also allows the saw blade to approach walls which are within confined areas, by collapsing the telescopic handle extension, or removing the quick release pin 74 to allow the handle to pivot freely downward. Once the opposing wall has been fully approached, the handle assembly 56 is pivoted rearwardly to raise the blade from the groove, and the motor 28 deactivated.

With the groove completed and the blade raised, the operator may simply roll the saw to the next groove location.

From the above description, it may be seen that the present invention provides a green concrete grooving tool which is both simple and efficient. The support of the saw by wheels ensures that operation of the device is smooth and easy. Additionally, the pivoting arrangement allows placement of the saw accurately and easily to the proper location. The cutting guide of the present invention provides sufficient support for the concrete surface to prevent damage thereto, but does not interfere with the forward progress of the saw. Finally, the saw of the present invention may be easily reduced to a compact size for storage or transport.

From the foregoing it will be seen that this invention is one well adapted to attain all ends and objects herein above set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A saw for grooving concrete, comprising:

a base;

a plurality of wheels rotatably mounted on said base for supporting said base and allowing movement of said base with respect to the surface of the concrete in a direction, at least a portion of said wheels being mounted on said base by an axle:

a frame mounted on said base for pivotal movement with respect to said base about a pivot axis defined by said axle and in a substantially vertical plane containing said direction, said frame including an abutment surface;

motor means mounted on said frame for counter-rotating a blade within said plane, said blade being spaced from said pivot axis, whereby pivotal movement of said frame with respect to said base will cause said blade to be lowered into contact with, and raised out of contact with, the concrete; and a handle assembly mounted to said base for pivotal motion about said axle in said plane, and including an abutment portion for selective contact with said abutment surface, whereby pivotal motion of said handle assembly in said plane with said abutment portion and abutment surface in contact will cause pivotal movement of said frame with respect to said base, and thus said raising and lowering of said blade.

2. A saw for grooving concrete, comprising:

a base;

a plurality of wheels rotatably mounted on said base for supporting said base and allowing movement of said base with respect to the surface of the concrete in a direction:

a frame mounted on said base for pivotal movement with respect to said base about a pivot axis and in a substantially vertical plane containing said direction, said frame including an abutment surface;

motor means mounted on said frame for counter-rotating a blade within said plane, said blade being spaced from said pivot axis of said frame, whereby pivotal movement of said frame with respect to said base will cause said blade to be lowered into contact with, and raised out of contact with, the concrete; and a handle assembly mounted to said base for pivotal motion in said plane, and including an abutment portion for selective contact with said abutment surface, whereby pivotal motion of said handle assembly in said plane with said abutment portion and abutment surface in contact will cause pivotal movement of said frame with respect to said base, and thus said raising and lowering of said blade:

a depth control rod mounted on said base and extending upwardly toward said frame and extending through said frame; and a collar adjustably fixed on said rod below said frame, whereby said frame may rest upon said collar and thereby limit downward pivotal movement of said frame with respect to said base.

3. A saw for grooving concrete, comprising:

a base having a blade slot through which said blade extends at least when said blade is in the lowered position;

a plurality of wheels rotatably mounted on said base for supporting said base and allowing movement of said base with respect to the surface of the concrete in a direction:

a frame mounted on said base for pivotal movement with respect to said base about a pivot axis and in a substantially vertical plane containing said direction, said frame including an abutment surface;

motor means mounted on said frame for counter-rotating said blade within said plane, said blade being spaced from said pivot axis, whereby pivotal movement of said frame with respect to said base will cause said blade to be lowered into contact with, and raised out of contact with, the concrete; and a handle assembly mounted to said base for pivotal motion in said plane, and including an abutment portion for selective contact with said abutment surface, whereby pivotal motion of said handle assembly in said plane with said abutment portion and abutment surface in contact will cause pivotal movement of said frame with respect to said base, and thus said raising and lowering of said blade;

a pair of dust deflectors, one of said deflectors being mounted at each longitudinal end of said blade slot; and a blade guard mounted on said frame and covering at least the upper half of said blade, said blade guard extending over at least a portion of said dust deflectors when said blade is in the lowered position.

4. A saw as in claim 3, wherein said blade guard includes a nozzle attachment extending into a cavity defined by said guard and containing said blade, said nozzle attachment adapted to be connected to a source of reduced atmospheric pressure.

5. A saw for grooving concrete, comprising:.

a base;

a plurality of wheels rotatably mounted on said base for supporting said base and allowing movement of said base with respect to the surface of the concrete in a direction:

a frame mounted on said base for pivotal movement with respect to said base about a pivot axis and in a substantially vertical plane containing said directions, said frame including an abutment surface;

motor means mounted on said frame for counter-rotating a blade within said plane, said blade being spaced from said pivot axis, whereby pivotal movement of said frame with respect to said base will cause said blade to be lowered into contact with, and raised out of contact with, the concrete; and a handle assembly mounted to said base for pivotal motion in said plane, and including an abutment portion for selective contact with said abutment surface, whereby pivotal motion of said handle assembly in said plane with said abutment portion and abutment surface in contact will cause pivotal movement of said frame with respect to said base, and thus said raising and lowering of said blade, said handle assembly including at least one handle bracket providing the pivotal connection with said base, a handle support selectively pivotable with respect to said handle bracket, and a handle extension telescopically connected to said handle support, whereby said handle assembly may be placed in an operative position with said handle support fixed with respect to said handle bracket and said handle extension extended from said handle support, or a storage position with said handle support pivoted with respect to said handle bracket and said handle extension contracted into said handle support.

* * * * *

UNITED STATES PATENT AND TRADEMARK OFFICE

CERTIFICATE OF CORRECTION

PATENT NO. : 5,381,780

DATED : January 17, 1995

INVENTOR(S) : Darrell A. YELTON and Kevin R. WILSON

It is certified that error appears in the above-identified patent and that said Letters Patent is hereby corrected as shown below:

Both instances (cover page item 54, and column 1, line 1) of the title should be corrected to --Green and Cured Concrete Saw--.

On the cover page, item 75, the city of residence of the first-named inventor should be corrected to read --Lee's Summit--;

On the title page, item 57, --a-- should be inserted following "by" in the second line.

Column 1, line 30, after "concrete" insert a period, and the test beginning with "is to cut ..." through and including "...biased blade." in line 50 should be removed and inserted following "concrete" at column 1, lines 54-55;

Line 58, "that" should be deleted and --than the-- inserted in its place.

UNITED STATES PATENT AND TRADEMARK OFFICE

CERTIFICATE OF CORRECTION

PATENT NO. : 5,381,780

DATED : January 17, 1995

INVENTOR(S) : Darrell A. YELTON and Kevin R. WILSON

It is certified that error appears in the above-indentified patent and that said Letters Patent is hereby corrected as shown below:

Column 8, lines 17-18, "tot he" should be corrected to "to the".

Column 14, line 27, "directions" should be corrected to the singular form "direction".

Signed and Sealed this

Fourth Day of April, 1995

*Attest:*

BRUCE LEHMAN

*Attesting Officer*

*Commissioner of Patents and Trademarks*